United States Patent [19]

Sager

[11] Patent Number: 5,030,192

[45] Date of Patent: Jul. 9, 1991

[54] PROGRAMMABLE FAN FOLD MECHANISM

[75] Inventor: Frank D. Sager, Centerville, Ohio

[73] Assignee: NCR Corporation, Dayton, Ohio

[21] Appl. No.: 579,418

[22] Filed: Sep. 7, 1990

[51] Int. Cl.[5] ..... B65H 45/107

[52] U.S. Cl. ..... 493/414; 493/18; 493/23; 493/411; 493/380

[58] Field of Search ..... 493/410, 411, 413, 414, 493/8, 10, 15, 18, 23, 25, 28, 34–36, 29, 380, 382

[56] References Cited

U.S. PATENT DOCUMENTS

| | | | |
|---|---|---|---|
| 4,030,720 | 6/1977 | Jones | 493/413 |
| 4,054,283 | 10/1977 | Rayfield | 493/10 |
| 4,723,488 | 2/1988 | Inouye et al. | 493/10 |
| 4,737,045 | 4/1988 | Koefferlein . | |
| 4,751,879 | 6/1988 | Van Pelt . | |
| 4,846,454 | 6/1989 | Parkander . | |

FOREIGN PATENT DOCUMENTS

| | | | |
|---|---|---|---|
| 0031704 | 3/1980 | Japan | 493/411 |
| 0031758 | 3/1980 | Japan | 493/411 |
| 0119659 | 9/1980 | Japan | 493/411 |
| 0119660 | 9/1980 | Japan | 493/414 |
| 0119661 | 9/1980 | Japan | 493/414 |
| 0113656 | 9/1981 | Japan | 493/411 |
| 0007672 | 1/1984 | Japan | 493/413 |

*Primary Examiner*—Frederick R. Schmidt
*Assistant Examiner*—John A. Marlott
*Attorney, Agent, or Firm*—Wilbert Hawk, Jr.; Albert L. Sessler, Jr.; Matthew R. Jenkins

[57] ABSTRACT

A method and apparatus for fan folding a continuous web of paper having transverse fan fold lines in fan folds having a preselected fan fold length when the continuous paper is moved along a feed line from an upstream area to a folding area. A controller energizes a drive motor to oscillate a discharge chute through a predetermined arc and at a predetermined rate to permit the continuous web of paper to be fan folded as the paper is moved through the discharge chute at the folding area. The method includes the steps comprising advancing the continuous web of paper through the discharge chute, generating a first signal representing the speed at which the paper is advanced towards the discharge chute, generating a second signal representing a predetermined distance between the transverse fan fold lines; and oscillating the discharge chute in response to the first signal and the second signal to move the discharge chute through an arc and at a speed which enables the web of continuous paper to be folded in a zig-zag manner along the transverse fan fold lines.

4 Claims, 4 Drawing Sheets

PROGRAMMABLE FAN FOLD MECHANISM

BACKGROUND OF THE INVENTION

1. Field of the Invention.

This invention relates to a programmable fan fold mechanism and more particularly it relates to an apparatus and method for fan folding continuous paper in fan folds having a preselected fan fold length when the continuous paper is moved along a feed line from an upstream area to a folding area.

2. Description of Related Art.

In the processing or handling of business forms and related products from a continuous paper roll, there is often the need to direct the flow of the continuous roll into a fan folded or accordian-like stack. In fan folding machines of the prior art, this was accomplished by feeding the continuous roll at a constant speed through a pivotally mounted guide chute which had a discharge end which was mechanically oscillated to fan fold the continuous roll. Typically, the discharge end of the guide chute was coupled to a pivot arm or lever which in turn was attached to a cam gear which was rotated at a constant speed which in turn caused the discharge end to oscillate. In order to vary the speed and distance that the discharge end of the chute oscillated, it was necessary to manually change either the pivot arm or the cam gear. Manually changing the pivot arm or cam gear results in down time of the fan folding machine and also requires additional parts and labor which are expensive.

SUMMARY OF THE INVENTION

This invention overcomes the problems previously mentioned by providing a programmable fan fold apparatus and method for fan folding continuous paper in fan folds having a preselected fan fold length when the continuous paper is moved along a feed line from an upstream area to a folding area.

In one aspect, this invention includes an apparatus for fan folding continuous paper in fan folds having transverse perforations spaced apart a predetermined distance and also having a preselected fan fold length when the continuous paper is moved along a feed line from an upstream area to a folding area; said apparatus comprising: a chute; support means for pivotally mounting the chute at the folding area; drive means coupled to the chute and the support means for oscillating the chute in a predetermined arc and at a predetermined rate; a sensor associated with the feed line for generating a first signal representing the speed at which the continuous paper is moved from the upstream area to the folding area; and control means coupled to the drive means for receiving a second signal representing the preselected fan fold length and also for receiving the first signal, said control means energizing the drive means to oscillate the chute through the predetermined arc and at the predetermined rate to cause the continuous web of paper to be folded at the fan folds as the paper is moved through the chute to the folding area.

In another aspect, this invention includes a method for folding a continuous web of paper having transverse fan fold lines which are spaced a predetermined distance apart, said method comprising the steps of: (a) advancing the continuous web of paper through a chute located at a folding area; (b) generating a first signal representing the speed at which the paper is advanced towards the chute; (c) generating a second signal representing the predetermined distance; and (d) oscillating the chute in response to the first signal and the second signal to move through an arc and at a speed which will cause the web of continuous paper to be folded in a zig-zag manner along the transverse fan fold lines.

A primary advantage of this invention is that it provides a programmable fan folding apparatus and method which permits a discharge chute to be oscillated at a predetermined rate and in a predetermined arc which will permit a continuous web of paper to be folded in preselected fan fold lengths as the paper is moved through the discharge chute.

Another advantage of this invention is that the fan folding apparatus can be programmed so that no manual or mechanical adjustment is required.

Yet another advantage of this invention is that the predetermined angle at which the discharge chute oscillates can be quickly and easily programmed so that a continuous roll can be folded in fan folds of any given length.

Still another advantage of this invention is that the rate at which the discharge chute oscillates can be quickly and easily changed so that speed at which a continuous roll is fed through the discharge chute can be varied.

DESCRIPTION OF THE PREFERRED EMBODIMENT

Figure 1:
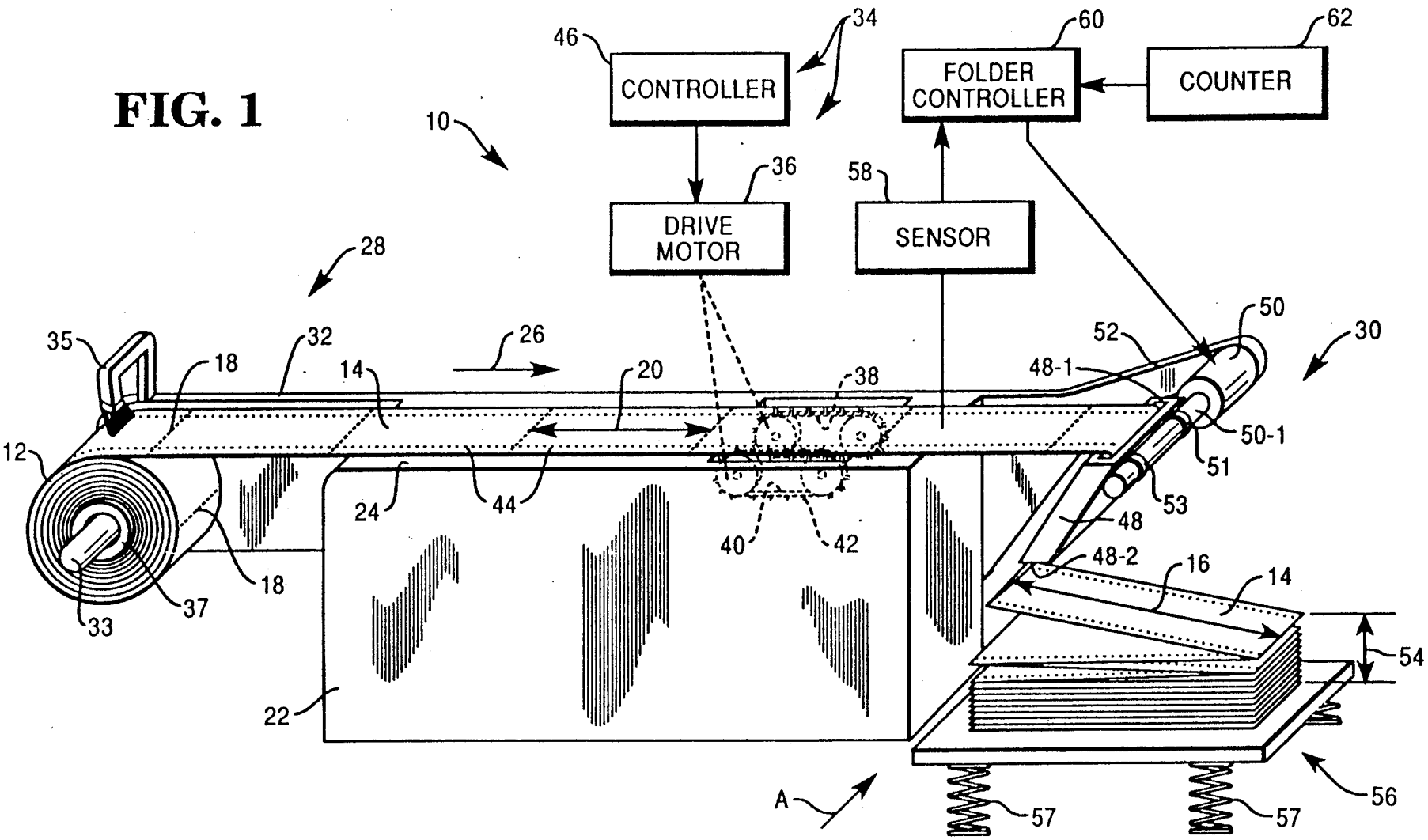
FIG. 1 is a schematic diagram, shown partially in isometric form, of a folding mechanism made according to the present invention.

FIG. 1 is a schematic diagram of a folding mechanism 10 according to the present invention. The function of the folding mechanism 10 is to fan fold a continuous roll or web 12 of forms 14 in a preselected fan fold length shown by double arrow 16. The continuous web 12 of forms 14 has transverse fan fold lines or perforations 18 which are spaced apart a predetermined distance shown by double arrow 20 and which traverse the entire width of the continuous web 12. In the embodiment being described, the predetermined distance 20 is equal to the preselected fan fold length; however, the preselected fan fold length could be selected to include multiple fan fold perforations 18 so that there is more than one form, like 14, between adjacent fan folds.

The folding mechanism 10 includes a housing 22 having a conveyor surface 24 for supporting the continuous web 12 as it is unrolled along a feed line or direction, indicated by arrow 26 in FIG. 1, from an upstream area 28 to a folding area 30. The folding mechanism 10 also includes a roll support 32 having a support rod 33 which supports or carries the continuous web 12. The roll support 32 includes a tension brush 35 which provides tension on the continuous web 12 to prevent the continuous web 12 from unwinding. A collar 37 retains the continuous web 12 in a mounted position on the support rod 33. A feed means 34 feeds or moves the continuous web 12 in the feed direction 26 and over the conveyor surface 24 from the upstream area 28 to the folding area 30. In the embodiment being described, the feed means 34 includes a drive motor 36 which is conventionally coupled by gears and pulleys (not shown) to a first endless pin belt 38 and a second endless pin belt 40. The endless pin belts 38 and 40 are positioned on opposite sides of the conveyor surface 24 towards the folding area 30, as best illustrated in FIG. 1. The first and second endless pin belts 38 and 40 each have a plurality of pins 42 which cooperate with a series of perforations 44 on the continuous web 12. The perforations 44 are spaced apart longitudinally in the margins of the continuous web 12. The folding mechanism 10 further includes a controller 46 which is coupled to the drive motor 36 and which controls the operation of the drive motor 36 to cause the endless pin belts 38 and 40 to rotate clockwise (as viewed in FIG. 1), thereby causing the forms 14 to be unrolled from the continuous web 12 in the feed direction 26 to the folding area 30. In the embodiment being described, the continuous web 12 can be moved at speeds of 0 to 4.17 feet per second.

The continuous web 12 is guided through a discharge chute 48 located at the folding area 30. In the embodiment being described, the discharge chute 48 has dimensions of 16.5×7×1 inches. A stepper motor 50 provides means for oscillating the discharge chute 48. A suitable stepper motor 50 is the Model 34D109 Stepper Motor, manufactured by the Anaheim Automation Co. of Anaheim, Calif. The stepper motor 50 is mounted by suitable fasteners (not shown) to means for supporting or support bracket 52 which is part of the housing 22. As best illustrated in FIG. 1, the discharge chute 48 has a first end 48-1 and a discharge end 48-2. The first end 48-1 includes a first connecting sleeve 51 and a second connecting sleeve 53 which are coupled (for example, by welding) directly to an armature 50-1 of the stepper motor 50.

The folding mechanism 10 also includes a velocity detector or sensor 58 which provides means for sensing the velocity of the continuous web 12 as it is fed towards the folding area 30 and also for generating an output signal in response thereto. A suitable sensor 58 is the Dynapar Rotopulser Sensor Model No. 42-600 which is manufactured by Anaheim Automation. The sensor 58 is mounted by suitable fasteners (not shown) on the housing 22 so as to be in operative relationship with the continuous web 12. The folding mechanism 10 further includes a counter 62. A count representing the number of stepper motor 50 steps required to move the discharge end 48-2 of discharge chute 48 the preselected fan fold length 16 is manually programmed into the counter 62. The counter 62 generates a second output signal when the stepper motor 50 has moved the discharge end 48-2 the number of steps equal to the count. This aspect of the invention will be covered in more detail hereinafter. A suitable counter 62 is the Gemini Model 2000, manufactured by Red Lion Controls of York, Pa.

Figure 2A:
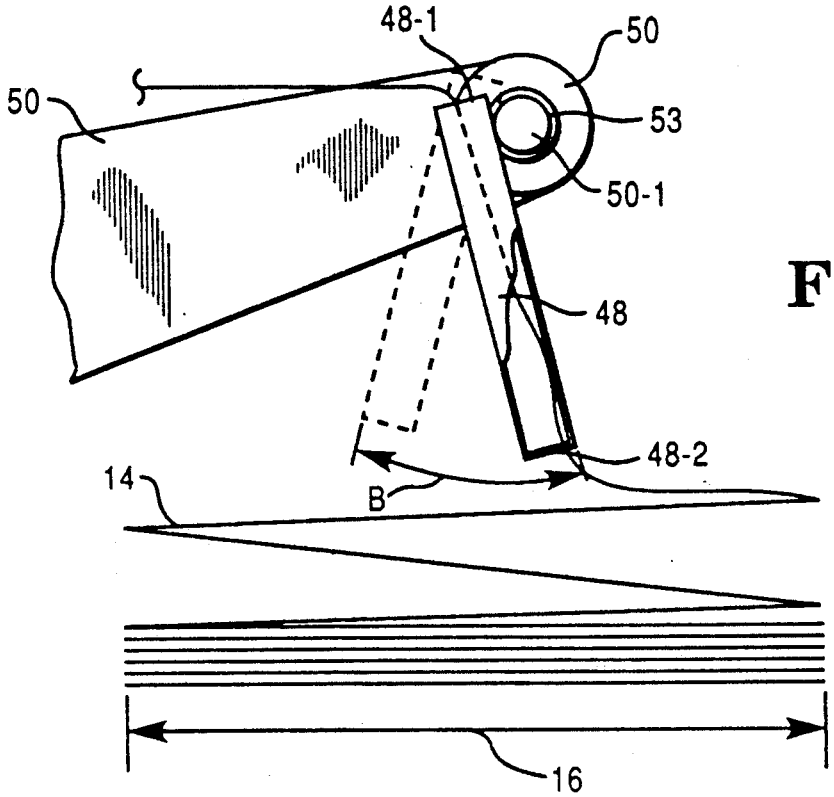
FIGS. 2A and 2B are fragmentary side views taken in the direction of arrow A in FIG. 1 showing the arc through which a discharge end of a discharge chute oscillates to fold a continuous roll of paper into an accordian-like stack.
Figure 2B:
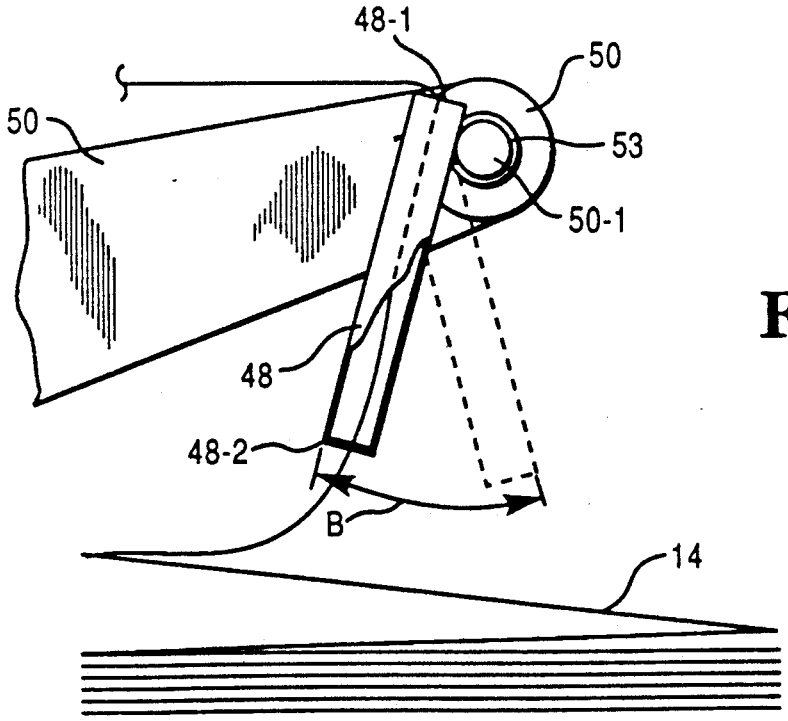
Figure 3:
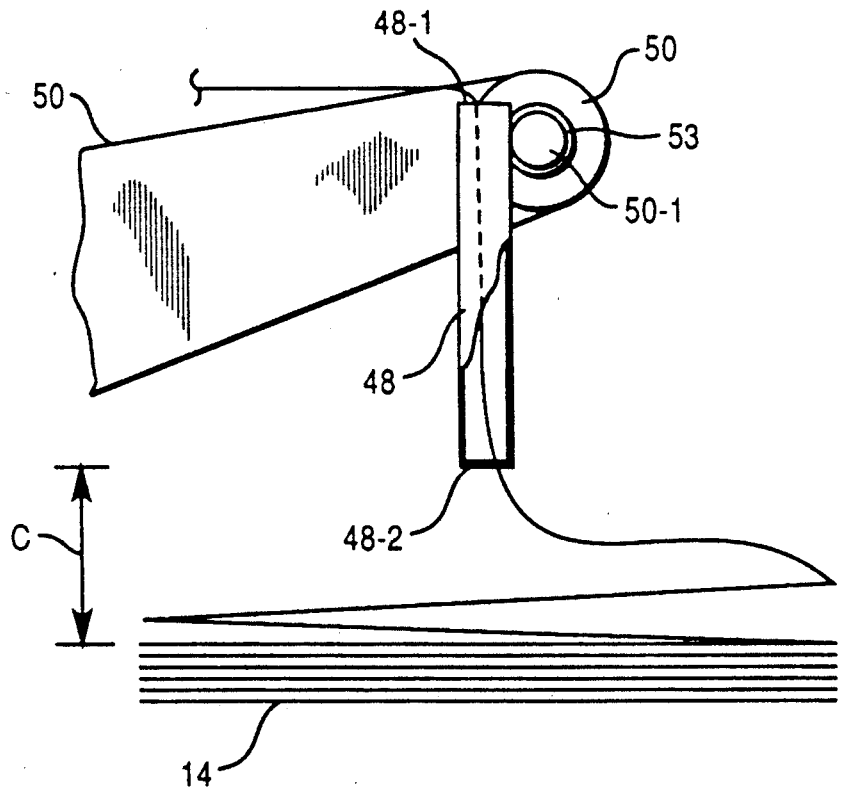
FIG. 3 is a fragmentary side view taken in the direction of arrow A in FIG. 1 showing the distance between the discharge end of the discharge chute at the bottom, of its arc and the top of the discharge stack.

The sensor 58, stepper motor 50, and counter 62 are each coupled to a folder controller 60, as best illustrated in FIG. 1. The function of the folder controller 60 is to control the operation of the stepper motor 50. A suitable folder controller 60 is Driver Pack Model DPB11RA1manufactured by Anaheim Automation Corporation. The folder controller 60 is programmable and can energize the stepper motor 50 to cause the discharge end 48-2 of the discharge chute 48 to oscillate back and forth at a predetermined rate and in any desired arc or predetermined angle, indicated by double arrow B in FIGS. 2A and 2B. In a preferred embodiment, the length of the predetermined angle B is less than two-thirds of the fan fold length 16. This facilitates folding the continuous web 12 along the fan fold perforations 18 to form a stack 54 (FIG. 1) of forms 14. A conventional spring rack 56 having springs 57 is located at the folding area 30 to receive the forms 14 as they are discharged by the discharge chute 48 and folded in a zig-zag manner on the stack 54. The springs 57 of the spring rack 56 become compressed as more forms 14 are stacked thereon so that the minimum distance (indicated by double arrow C in FIG. 3) between the bottom of the discharge end 48-2 and the top of the stack 54 of forms 14 is maintained at 3 inches when the discharge end 48-2 is at the bottom of its arc of movement.

The folder controller 60 can be programmed to determine the predetermined rate and predetermined angle B which will cause the discharge chute 48 to fold the continuous web 12 at the fan fold perforations 18 as the continuous web 12 is fed through the discharge chute 48 in response to the output signal from sensor 58 and the second output signal from the counter 62. The folder controller 60 then energizes the stepper motor 50 to oscillate the discharge end 48-2 at the predetermined rate and predetermined angle B. The counter 62 generates the second output signal after the stepper motor 50 has teen energized to move the number of stepper motor steps representing the length of the angle or arc B in either direction, for example, from right to left (as viewed in FIG. 2A). In response to the second output signal, the folder controller 60 then energizes stepper motor 50 to cause the discharge end 48-2 of discharge chute 48 to move in the opposite direction from left to right (as viewed in FIG. 2B). For example, if the preselected fan fold length 16 is 12 inches and the forms 14 are fed at 4 feet per second, then the folder controller 60 may energize the stepper motor 50 to oscillate the discharge chute 48 at the predetermined angle B of approximately 55 degrees (FIG. 2A) or arc length of 8 inches. In addition, the folder controller 60 would also cause the discharge chute 48 to oscillate at the predetermined rate of 220 degrees per second. The folder controller 60 thereby causes the discharge chute 48 to oscillate in synchronization with the velocity of the forms 14 as they are fed through the discharge chute 48 so that the forms 14 become stacked and fan folded on the spring rack 56 in the zig-zag manner shown in FIG. 1.

Figure 4:
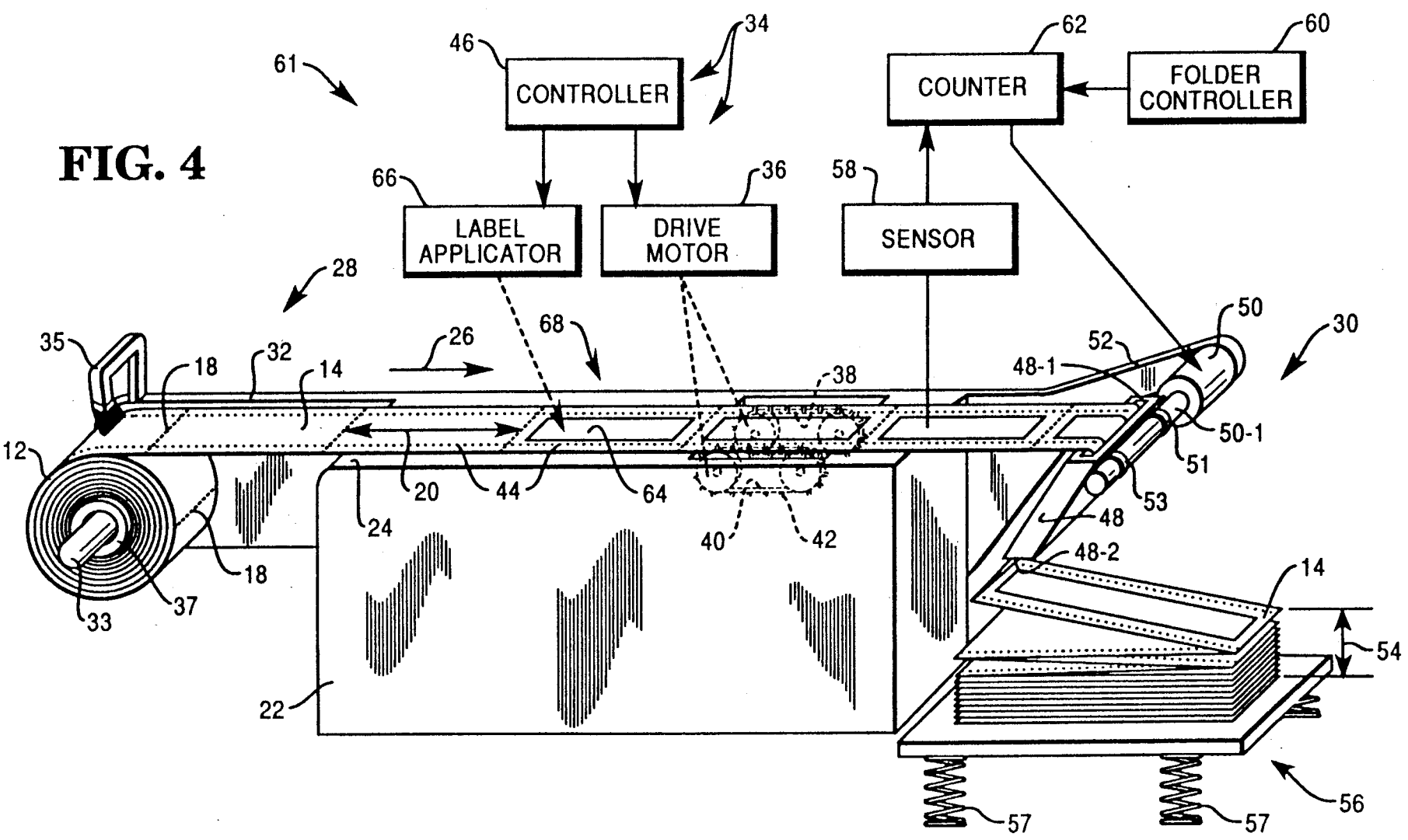
FIG. 4 is a label application machine in which the folding mechanism may be utilized.

FIG. 4 shows a label applicator machine 61 in which the folding mechanism 10 may be used. The function of the label applicator machine 61 is to apply adhesive labels 64 to each form 14. Those parts and components of the label applicator machine 61 shown in FIG. 4 which are identical to the parts and components of the folding mechanism 10 described earlier herein have been identified with the same part numbers. The label applicator machine 61 includes a conventional label applicator 66 which applies the label 64 to each form 14. The label applicator 66 is coupled to the controller 46 and is mounted to the housing 22 by suitable fasteners (not shown) and generally positioned at a label application station 68 between the upstream area 28 and the folding area 30. As the forms 14 are fed past the label application station 68, the controller 46 causes the label applicator 66 to apply the label 64 to each form 14. A suitable label applicator 66 is the model Mark VI Stepper Motor Drive Labeler, manufactured by Quadrel Labeling Systems Inc. of East Lake, Ohio. The continuous web 12 of forms 14 is subsequently folded in the manner described earlier herein.

Various changes or modifications in the invention described may occur to those skilled in the art without departing from the spirit or scope of the invention. For example, the folding mechanism 10 could be used to re-fold a continuous web or stack (not shown) of pre-folded forms 14. This is particularly useful when refolding a pre-folded web of forms 14 after the label 64 has been applied to each form 14. The above description of the invention is intended to be illustrative and not limiting, and it is not intended that the invention be restricted thereto but that it be limited only by the true spirit and scope of the appended claims.

What is claimed is:

1. An apparatus for applying labels to a continuous web of paper having transverse fan fold lines which are equally spaced apart a predetermined fold length, said apparatus comprising:

a label application station;

a folding area;

feed means for feeding the continuous web of paper along a feed line from an upstream area through said label application station to said folding area;

a label applicator located at said label application station for applying labels between said transverse fan folds as said continuous web of paper is fed along said feed line through said label application station;

a chute;

support means for pivotally mounting said chute at said folding area;

drive means coupled to said chute for causing said chute to oscillate through an arc;

independent sensor means in operative relationship with the web located between said label applicator and said chute for generating a first signal representing the speed at which the continuous web of paper is fed to said folding area;

counter means for generating a second signal representing the predetermined fold length;

control means coupled to said independent sensor means and said drive means for receiving said first signal and said second signal, said control means energizing said drive means to oscillate said chute through said arc and at a speed which enables said chute to fold the continuous paper at said fan folds as the continuous paper is fed through said chute at said folding area.

2. The apparatus as recited in claim 1 in which said arc length is less than $\frac{2}{3}$ of said predetermined fold length.

3. The apparatus as recited in claim 1 in which said counter means includes a programmable counter for generating said second signal representing said predetermined fold length.

4. The apparatus as recited in claim 1 in which said continuous web of paper is pre-folded.

* * * * *